United States Patent [19]

Schröder

[11] Patent Number: 4,831,865

[45] Date of Patent: May 23, 1989

[54] LOWER TOOL SUPPORT FOR A STAMPING MACHINE OR THE LIKE

[75] Inventor: Werner Schröder, Finnentrop, Fed. Rep. of Germany

[73] Assignee: Muhr und Bender, Attendorn, Fed. Rep. of Germany

[21] Appl. No.: 111,721

[22] Filed: Oct. 22, 1987

[30] Foreign Application Priority Data

Nov. 4, 1986 [DE] Fed. Rep. of Germany ..... 3637485

[51] Int. Cl.[4] ..... B21D 22/00; B21D 28/14; B21D 28/34; B21D 37/04

[52] U.S. Cl. ..... 72/448; 72/482

[58] Field of Search ..... 72/446, 447, 448, 462, 72/482

[56] References Cited

U.S. PATENT DOCUMENTS

| | | | |
|---|---|---|---|
| 280,998 | 7/1883 | Baker | 72/447 |
| 1,651,483 | 12/1927 | Talcott | 72/446 |
| 2,031,345 | 2/1936 | Tinkham | 72/448 X |
| 2,942,503 | 6/1960 | Fitzgerald | 72/446 X |

FOREIGN PATENT DOCUMENTS

| | | | |
|---|---|---|---|
| 59-127935 | 7/1984 | Japan | 72/482 |
| 606672 | 5/1978 | U.S.S.R. | 72/482 |

*Primary Examiner*—E. Michael Combs
*Attorney, Agent, or Firm*—Browdy and Neimark

[57] ABSTRACT

A lower tool support for a stamping machine or the like having a lower frame and a tool saddle with a saddle plate, movably disposed on the saddle surface of the lower frame, with adjusting devices for the adjustment of the tool saddle in relation to the lower frame in the plane of the saddle surface and an arresting device for fixing the tool saddle on the lower frame being provided, the saddle plate of the tool saddle having at least one lower flange and the arresting device having at least one fastening flange formfittingly overlapping the lower flange, the fastening flange in the plane of the saddle surface having an exactly determined relative position in respect to the lower frame, thus securing the saddle plate against vertical lifting from the saddle surface. In the installation of the tool saddle this lower tool support has the vertical distance of the fastening flange of the arresting device from the saddle surface of the lower frame exactly predetermined and is somewhat larger than the thickness of the lower flange of the saddle plate.

20 Claims, 3 Drawing Sheets

LOWER TOOL SUPPORT FOR A STAMPING MACHINE OR THE LIKE

The invention relates to a lower tool support for a stamping machine or the like, having a lower frame with a front, sides and a back oriented toward a machine frame and a tool saddle with a saddle plate, movably disposed on the saddle surface of the lower frame, with adjusting devices for the adjustment of the tool saddle in relation to the lower frame in the plane of the saddle surface and an arresting device for fixing the tool saddle on the lower frame being provided, the saddle plate of the tool saddle having at least one lower flange and the arresting device having at least one fastening flange formfittingly overlapping the lower flange, the fastening flange securing the saddle plate against vertical lifting—lifting in a vertical direction—from said saddle surface.

BACKGROUND OF THE INVENTION

The known lower tool support on which the invention is based (brochure entitled "MUBEA KBLH HYDRAULIC" and German Laid-open application DE-OS No. 34 32 671) has a tool saddle straddling a lower frame, which can be made in one piece with the machine frame of the stamping machine, from above in a saddle-like manner with two sides pieces. In the case of its use as a punch press, the lower frame can have punching supports extending upwards on which a cantilever-like upward part of the tool saddle is vertically supported. The punching forces which occur are thus transferred to the machine frame. However, the tool saddle can also be plate-like, in which case a tool receptacle with an exchangeable standard tool holder is provided. It is important that the tool saddle be movable on the saddle surface in relation to the lower frame by means of adjusting devices so that it can be adjusted in relation to an upper tool.

The adjusting devices for the tool saddle of the known lower tool support still are too complicated to operate. To newly set up the tool saddle, first the arresting device must be undone, then two lateral and two longitudinal adjustments must be loosened, adjusted and tightened again. Then the arresting device must be fastened again.

SUMMARY OF THE INVENTION

It is therefore an object of the invention to improve, or simplify, the known lower tool support in regard to the installation of the tool saddle.

The lower tool support of the invention is characterized in that the distance of said fastening flange from said saddle surface in said vertical direction—vertical distance—is exactly preset, it being somewhat larger than the thickness of said lower flange of said saddle plate.

In contrast to the known lower tool support which is the basis of the invention, the arresting device of the lower tool support of the invention no longer needs to be loosened and retightened for the new set up of the tool saddle in respect to the lower frame. The arresting device here only serves to maintain the tool saddle on the saddle surface in a vertical direction and to form a guide for the tool saddle on the saddle surface in the plane of the saddle surface.

It has been realized that with this type of construction of the arresting device the adjustment devices can be sufficiently well adjusted to attain a completely satisfactory fixation of the tool saddle on the lower frame during operation.

DETAILED DESCRIPTION OF THE PREFERRED EMBODIMENT

Figure 1:
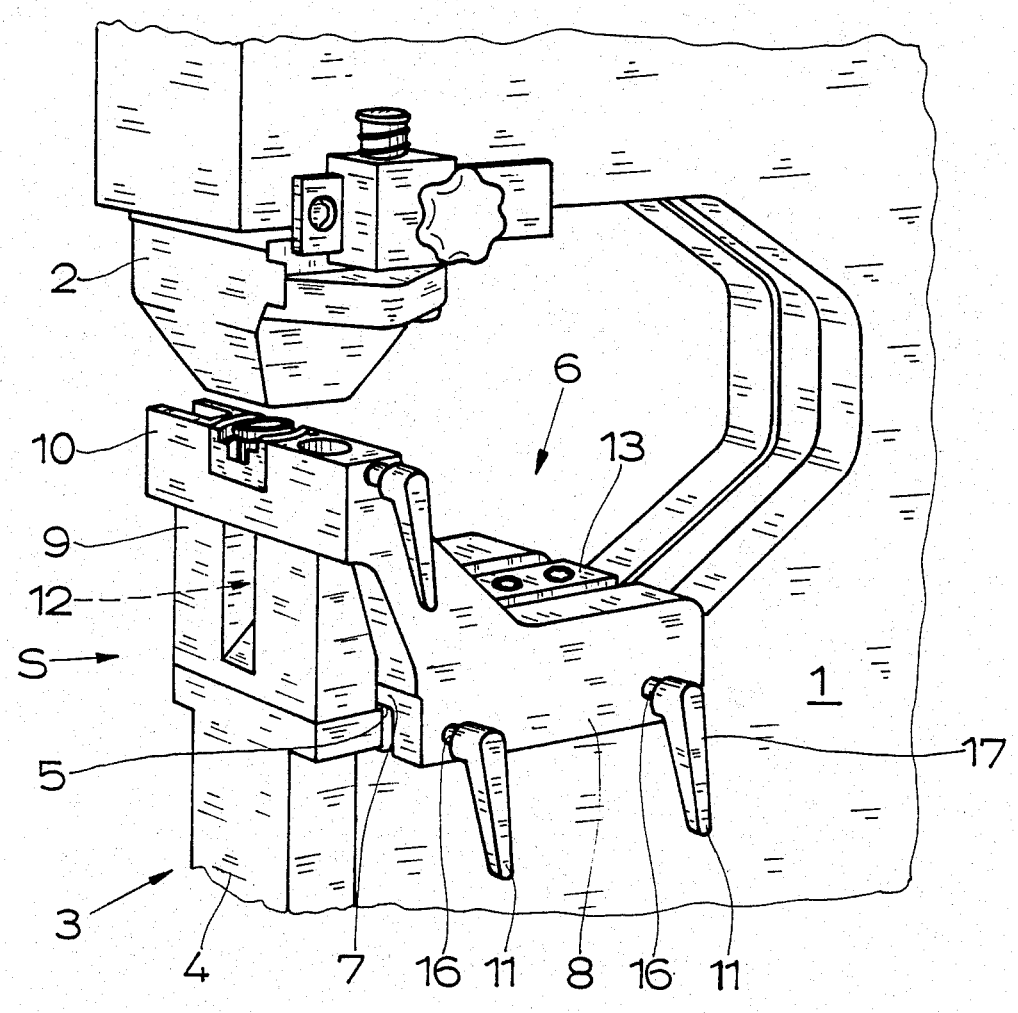
FIG. 1 is a partial, perspective and schematic view of a machine tool, in particular a punch press.

FIG. 1 shows schematically in a perspective and partial view the stamping area of a large hydraulic machine tool. The machine frame 1 in the form of the letter C and an upper tool 2 attached to it are easily discernible. The lower part of the machine frame 1 constitutes a lower tool support 3. In the exemplary embodiment here shown, it is a stamping machine, in particular a punch press, however, the teaching of the invention can also be applied to all types of other lower tool supports 3 of machine tools. The lower tool support 3 has a lower frame 4 with a front S, sides and a back oriented toward the machine frame 1. A tool saddle 6 with a saddle plate 7 is movably disposed on a saddle surface 5 of the lower frame 4. In detail the tool saddle 6 has, as known per se, lateral flanges 8 extending downward from the saddle plate 7 in the form of a U and, in the exemplary embodiment of a punch press shown here, a tool cantilever 10 extending obliquely upwards and supported in a vertical direction on supports 9 of the lower frame 4. Furthermore, adjusting devices 11, 12 for adjusting the tool saddle 6 in respect to the lower frame 4 in the plane of the saddle surface 5 and an arresting device 13 for fixing the tool saddle 6 on the lower frame 4 in a direction perpendicular to the plane of the saddle surface 5 are visible or, respectively, sketched in. From FIGS. 2, 3, and 4 one may obtain that the saddle plate 7 of the tool saddle 6 has at least one lower flange 14 and the arresting device at least one fastening flange 15 formfittingly overlapping the lower flange 14 and that the fastening flange 15 prevents the saddle plate 7 or, respectively, the tool saddle 6 from vertical lifting—lifting in a vertical direction—from the saddle surface 5.

Figure 4:
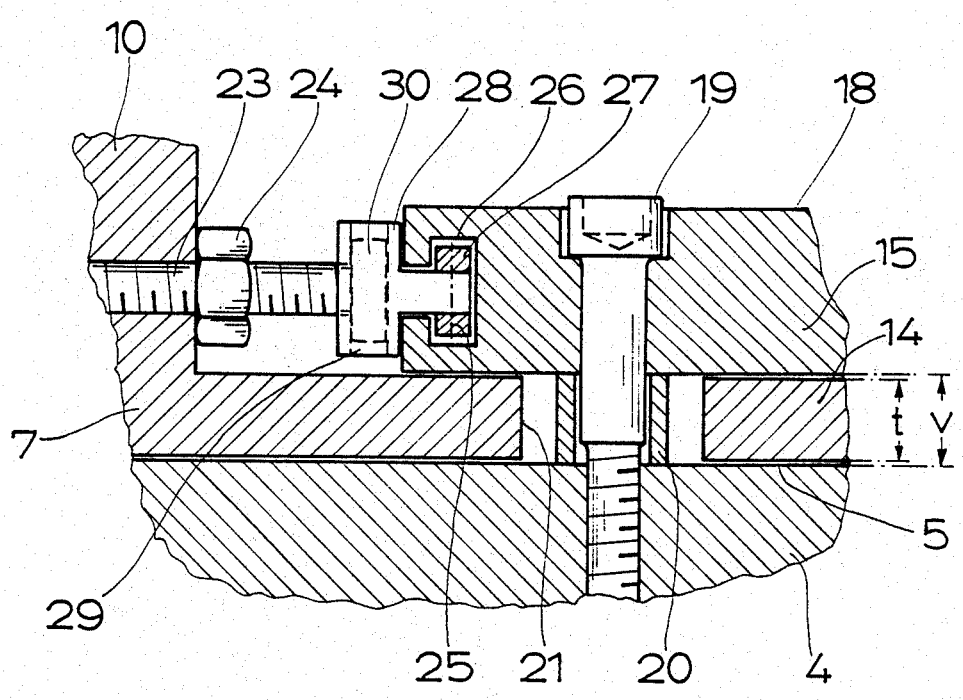
FIG. 4 is a partial enlarged section along the line IV—IV through the tool saddle of FIG. 3.

Particularly FIG. 4 shows that the distance of the fastening flange 15 of the arresting device 13 from the saddle surface 5 of the lower frame 4 in said vertical direction—vertical distance v—is exactly preset, it being somewhat larger than the thickness t of the lower flange 14 of the saddle plate 7. This assures that by means of the fastening flange or flanges 15 of the arresting device 13, lifting of the tool saddle 6 from the saddle surface 5 in said vertical direction is made impossible. Nevertheless, as said vertical distance v is somewhat larger than said thickness t the saddle plate 7 with the tool saddle 6 is readily movable in the plane of the saddle surface 5. In contrast to conventional constructions, where the arresting device 13 provides for fixing of the saddle plate 7 even in the plane of the saddle surface 5, now the adjustment and fixing in the plane of the saddle surface 5 is done exclusively by the adjustment devices 11, 12, and no longer by the arresting device 13. Thus the loosening and refastening of the arresting device 13 is no longer required when the tool saddle 6 is to be newly set up. Because of the scale of the display in FIG. 1 those facts are not fully discernible there, but in FIG. 4 those facts are clearly obtainable.

Furthermore, FIG. 1 shows that two lateral adjustments 11 are provided on each side of the tool saddle 6. Two lateral adjustments 11 each are disposed opposite each other near the front S of the tool saddle 6 and near the back of the tool saddle 6. In the preferred exemplary embodiment shown here the lateral adjustments 11 each have a screw shaft 16 screwed into a screw bore in the tool saddle 6 and abutting in a butt-jointed manner on the lower frame 4. At each end of the screw shaft 16 a trip bolt lever 17 is disposed. Trip bolt levers 17 have the advantage, as compared with ordinary hexagonal screws, that they can be quickly operated without need of a tool. Thus a rapid operation is assured for the lateral adjustments 11, because it is only required to turn the opposed pairs of lateral adjustments 11, or, respectively, their trip bolt levers 17, in the same direction in order to adjust the tool saddle 6 in a lateral direction. The total of four lateral adjustments 11 provided also permit a slight inclination of the tool saddle 6. Because the screw shafts 16 of the lateral adjustments 11 abut the lower frame 4 in a butt-jointed manner, as known per se, the tool saddle 6 can easily be upwardly lifted off the lower frame 4 when the trip bolt levers 17 and the arresting device 13 are loosened.

In the preferred embodiment of the invention shown here there is exactly one adjusting device for the adjustment of the tool saddle 6 in the longitudinal direction of the saddle surface 5 provided—longitudinal adjustment 12—which can be operated from the front S. This is indicated with a dashed line in FIG. 1 and displayed in FIGS. 2 and 3 in more detail. Since the longitudinal adjustment 12 can be operated from the front S, a quick adjustment of the saddle 6 in the longitudinal direction is also possible. It can be seen in FIG. 1 that the longitudinal adjustment 12 is accessible through the waste chute below the lower stamping tool.

There are a number of possibilities in regard to the embodiment of the arresting device 13 of the lower tool support of the invention, which are described in connection with the preferred exemplary embodiment shown in FIGS. 2 to 4.

It is first recommended that the fastening flange 15 and the saddle surface 5 on the one hand form a movable seating with the lower flange 14 having, particularly, a clearance of +0.05 mm.

Looking in the longitudinal direction of the saddle plate 7, there are disposed two fastening flanges 15, each of which overlaps one of two lower flanges 14 disposed on the saddle plate 7. This form of construction assures a particularly secure and symmetrical distribution of the forces occurring in the arresting device 13.

It would be easily possible to form the fastening flange or, respectively, flanges on the lower frame or, respectively, to weld them to it. In that case the saddle plate or, respectively, the lower flanges would only be slidable into the arresting device from one side, particularly from the front, in the plane of the saddle surface. However, it is easier from the point of ease of construction and in view of the changing of the tool saddle 6, because it becomes possible to form a sliding seat with better fit, if the fastening flange 15 is formed on a top plate 18 or, respectively, the fastening flanges 15 are combined in a top plate 18.

In detail here the lower flange 14 of the saddle plate 7 is provided for only in a functional manner, being nothing but a specific part of the saddle plate 7 with an upwardly facing force transmitting surface. Correspondingly the fastening flange 15 of the arresting device 13 is nothing but a specific part of the arresting device 13 having a downwardly facing force transmitting surface.

The lower flange 14 could be formed on the saddle plate 7 as a slim edge projecting from the saddle plate 7 to the side. The same could hold for the fastening flange 15 on the arresting device 13. In the embodiment shown, however, the lower flange 14 of the saddle plate 7 is formed by the whole part of the saddle plate 7 lying below the top plate 18.

Figure 2:
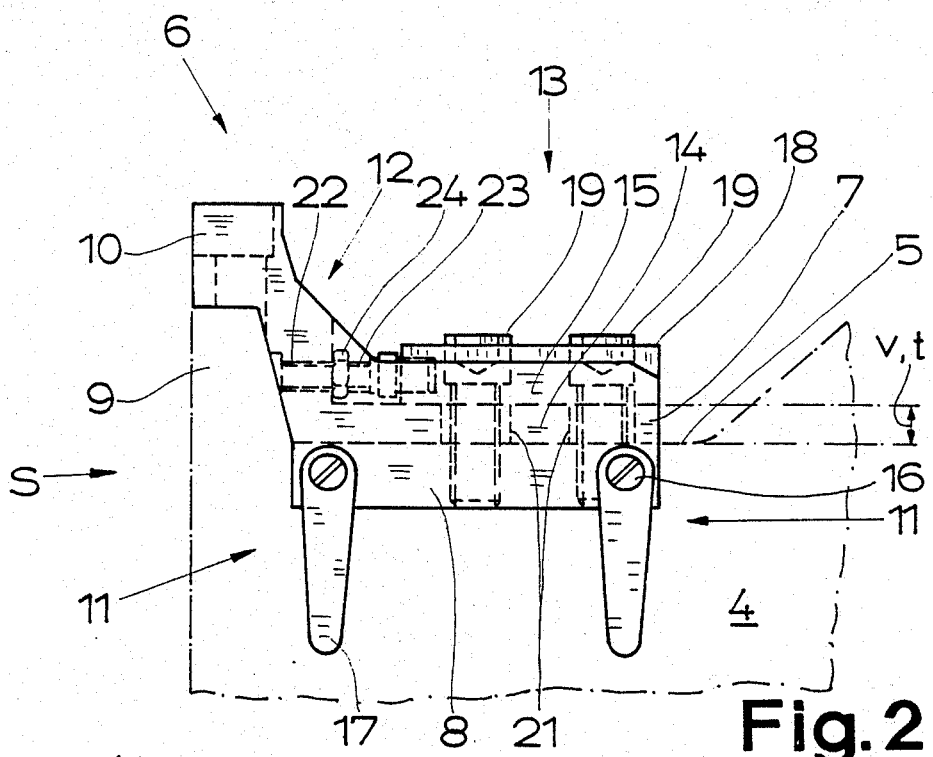
FIG. 2 is a schematically simplified side view of a tool saddle for a lower tool support according to the invention.
Figure 3:
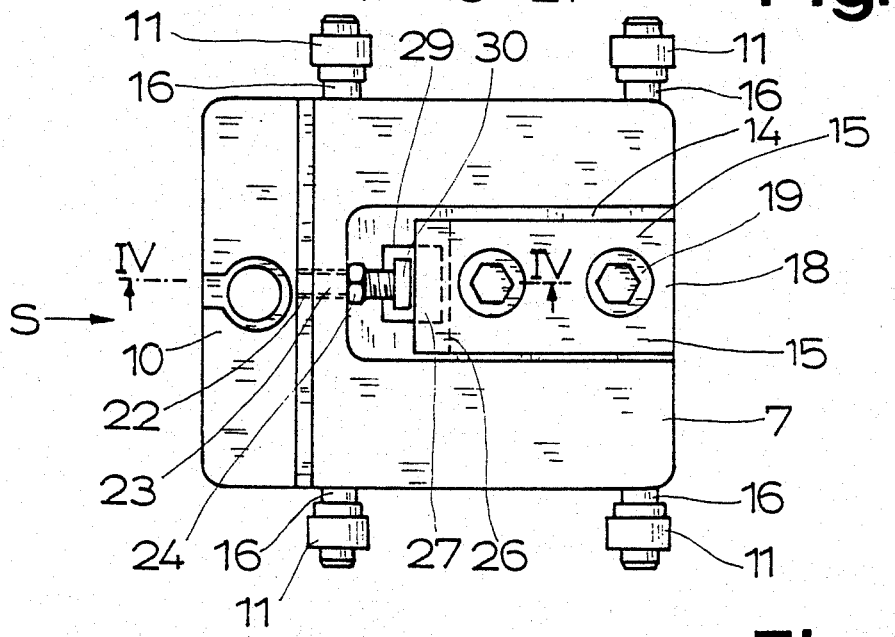
FIG. 3 is a top view of the tool saddle of FIG. 2.

Of course, the top plate 18 must be fixedly connected with the lower frame 4 in some way and it is particularly practical if, as clearly shown in FIGS. 2 to 4, the top plate 18 is connected with the saddle surface 5 by means of two fastening screws 19. The head of each fastening screw 19 can be drawn down to the saddle surface 5 up to an exactly determined distance. The distance to which the head of each fastening screw 19 is to be drawable to the saddle surface 5 is found as the result of the requirement that the distance of the fastening flange 15 from the saddle surface 5 should be somewhat greater than the thickness of the lower flange 14 of the saddle plate 7 so that a sliding seat results. The distancing of the heads of the fastening screws 19 can be achieved by a corresponding screw bore for each fastening screw 19 in the lower frame 4 having an exactly determined depth, thus exactly determining the insertion depth of each fastening screw 19. In this way the top plate 18 is disposed "floatingly" on the saddle surface 5 or, respectively, on the lower flanges 14 of the tool saddle 6. An alternative to this is shown in FIG. 4 which is characterized in that the shaft of each fastening screw 19 is surrounded by a spacer 20 in the area of the saddle plate 7 and in that the length of the spacer is minimally greater than the thickness of the saddle plate 7 or, respectively, the lower flange 14. In this case the top plate 18 does not "float" on the saddle plate 7 or, respectively, the lower flanges 14, but is firmly attached to the lower frame by means of the fastening screws 19 and the spacers 20. The fastening screws 19 should be snugly seated in the top plate 18. In the preferred embodiment shown here the fastening screws 19 are provided in the form of hollow screws. In this manner the top plate 18 has an absolutely secure and exactly determined relative position in respect to the saddle surface 5.

As already indicated above in the preferred embodiment shown here the lower flanges 14 of the tool sandle 6 are not elongated flanges extending in the longitudinal direction, but have been formed in the continuously formed saddle plate 7. The saddle plate 7 has a push-through opening 21 for each fastening screw 19 for the formation of the lower flange 14 and preferably the push-through opening 21 is in the form of a slotted hole or a hole with a larger diameter. This design permits limited free movement of the saddle plate 7 with the tool saddle 6 in the plane of the saddle surface 5 and, at the same time, results in the largest possible force transfer surface between the fastening flanges 15 or, respectively, the top plate 18 on the one hand and the lower flanges 14 or, respectively, the saddle plate 7 on the other.

FIGS. 2 to 4 also show special features in regard to the design of the longitudinal adjustment 12. Firstly, it can be seen that the longitudinal adjustment 12 has a screw bore 22, disposed in the tool saddle 6 and originating at the front S and a screw shaft 23 screwed into the screw bore 22. The screw shaft 23 is pivotably but axially fixed, connected on its back end with a fastening flange 15, particularly with the top plate 18. It is not visible in the drawings that the screw shaft 23 is, in accordance with a preferred teaching, in the form of a set screw, particularly a slotted set screw. However, it can be seen that the screw shaft 23 on the side towards the back has a counter nut 24 or the like. The counter nut 24 is used for the fixing of the longitudinal adjustment 12. FIG. 3 shows in particular that there is a free space, accessible from above, between the tool saddle 6 and the fastening flange 15 or, respectively, the top plate 18, for the operation of the counter nut 24.

As FIGS. 2, 3 and 4, taken together, show, it is true in connection with the longitudinal adjustment 12 that the back end of the screw shaft 23 on the one hand and the top plate 18 on the other hand have connecting devices 26, 27; 28, 29 associated with each other and that by means of the connecting devices 26, 27 it is possible to displace the end of the screw shaft 23 in respect to the top plate 18, in a lateral direction whereas by means of the connecting devices 29, 30 it is possible to turn the screw shaft 23 in respect to the top plate 18 around an axis 25 oriented vertically to the saddle surface 5. This provides the connection of the screw shaft 23 of the longitudinal adjustment 12 with the top plate 18 with the largest possible number of degrees of freedom so that a completely free adjustment in a lateral direction of the tool saddle 6 on the bottom frame 4 is possible without interfering with the longitudinal adjustment 12.

In the preferred exemplary embodiment shown here the connecting devices 26, 27 described above are particularly designed such that the top plate 18 has a groove 26, open toward the front S, extending laterally, particularly a T-groove or dovetailed groove, and that the back end of the screw shaft 23 is provided with a corresponding sliding block 27. For the connecting devices 28, 29 a pivot mount 28 is placed at the sliding block 27 and is pivotable around the axis 25. The sliding block 27 or, respectively, the pivot mount 28 has a T-groove 29 open at the top and a bearing part 30 provided at the end of the screw shaft 23 is inserted into the T-groove 29. The hammerhead-like connection of the screw shaft 23 of the longitudinal adjustment 12 with the top plate 18, formed by the T-groove 29 and the bearing part 30, as realized in the exemplary embodiment of FIG. 4, permits the easy removal of the top plate 18 in an upward direction, after the fastening screws 19 have been loosened when the bearing part 30 slides out of the T-grooves 29. All other parts remain on the tool saddle 6 which can be simply removed from the lower frame 4 after the lateral adjustments 11 have been loosened.

A particularly quickly adjustable and easily exchangeable tool saddle 6 on a lower frame 4 has been realized by the invention, this type of quick saddle adjustment being universally applicable to all types of lower tool supports.

I claim:

1. A lower tool support for a stamping machine or the like, comprising:

a lower frame with a front, sides and a back oriented toward a machine frame;

a tool saddle with a saddle plate, the tool saddle being movably disposed on a saddle surface of said lower frame;

adjusting devices for adjustment of said tool saddle in relation to said lower frame in the plane of said saddle surface;

an arresting device for fixing said tool saddle on said lower frame;

said saddle plate of said tool saddle having at least one lower flange and;

said arresting device having at least one fastening flange formfittingly overlapping said lower flange, said fastening flange securing said saddle plate against being lifted upwardly in a vertical direction from said saddle surface, said fastening flange being disposed a preset distance from said saddle surface in the vertical direction, said preset distance being somewhat larger than the thickness of said lower flange of said saddle plate.

2. A tool support in accordance with claim 1, wherein said adjusting devices comprise two sets of lateral adjustment devices, each set provided on opposite sides of said tool saddle from each other near a front portion of said tool saddle and near a back portion of said tool saddle.

3. A tool support in accordance with claim 2, wherein each of said lateral adjustment devices comprises a screw shaft screwed into a screw bore in said tool saddle and abutting said lower frame butt-jointedly and a trip bolt lever disposed on the end of each screw shaft.

4. A tool support in accordance with claim 1, wherein said adjusting devices comprise exactly one longitudinal adjustment device for the adjustment of said tool saddle in a longitudinal direction of said saddle surface and which can be operated from the front of said lower frame.

5. A tool support in accordance with claim 1, wherein said fastening flange and said saddle surface form a sliding seat with said lower flange having a clearance of substantially +0.05 mm.

6. A tool support in accordance with claim 1, wherein said at least one fastening flange comprises two fastening flanges and said at least one lower flange comprises two lower flanges and said two fastening flanges being disposed so as to overlap one of each of said two lower flanges disposed on said saddle plate, in the longitudinal direction of said saddle plate.

7. A tool support in accordance with claim 6, wherein said fastening flanges are formed in one piece with said lower frame.

8. A tool support in accordance with claim 6, wherein said fastening flanges are welded to said lower frame.

9. A tool support in accordance with claim 6, wherein said fastening flanges are formed on a top plate.

10. A tool support in accordance with claim 9, further comprising at least one fastening screw for connecting said top plate with said saddle surface, and wherein a head of each said fastening screw can be drawn to said saddle surface to an exactly determined distance.

11. A tool support in accordance with claim 10, wherein a shaft of each said fastening screw is surrounded by a spacer, the length of said spacer being minimally larger than the thickness of said saddle plate.

12. A tool support in accordance with claim 10, wherein said saddle plate has a push-through opening for each said fastening screw for the formation of said lower flange and said push-through opening is provided as a hole with a larger diameter than the diameter of the fastening screw.

13. A tool support in accordance with claim 10, wherein said adjusting devices comprise exactly one longitudinal adjustment device for the adjustment of said tool saddle in a longitudinal direction of said saddle surface which can be operated from the front of said lower frame, said longitudinal adjustment device having a screw bore provided in said tool saddle originating at the front thereof and a screw shaft screwed into said screw bore, said screw shaft being pivotably and axially fixedly connected on its back end with said top plate.

14. A tool support in accordance with claim 13, wherein said screw shaft is a set screw.

15. A tool support in accordance with claim 13, wherein said screw shaft has a counter nut means on its side towards the back.

16. A tool support in accordance with claim 15, wherein there is a free space, accessible from above, between said tool saddle and said top plate for the operation of said counter nut.

17. A tool support in accordance with claim 13, wherein the back end of said screw shaft and said top plate have connecting devices associated with each other and, by means of said connecting devices, it is possible to displace the end of said screw shaft in respect to said top plate in a lateral direction and to turn said screw shaft in respect to said top plate around an axis oriented vertically to said saddle surface.

18. A tool support in accordance with claim 17, wherein said top plate has a dovetailed groove open towards the front extending laterally and the back end of said screw shaft is provided with a corresponding sliding block.

19. A tool support in accordance with claim 18, wherein a pivot mount is placed at said sliding block which is pivotable around an axis oriented vertically to said saddle surface.

20. A tool carrier in accordance with claim 17, wherein a sliding block has a T-groove open above, and a bearing part attached to the end of said screw shaft is inserted into said T-groove.

* * * * *